US009790698B2

(12) United States Patent
Koch et al.

(10) Patent No.: US 9,790,698 B2
(45) Date of Patent: Oct. 17, 2017

(54) SEATING SYSTEM

(71) Applicant: ROGERS ATHLETIC COMPANY, INC., Clare, MI (US)

(72) Inventors: Joshua William Koch, Clare, MI (US); Timothy John Hockemeyer, Midland, MI (US); Brian Staten, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 0 days.

(21) Appl. No.: 15/370,519

(22) Filed: Dec. 6, 2016

(65) Prior Publication Data

US 2017/0081868 A1 Mar. 23, 2017

Related U.S. Application Data

(62) Division of application No. 14/807,191, filed on Jul. 23, 2015, now Pat. No. 9,540,831.

(60) Provisional application No. 62/027,964, filed on Jul. 23, 2014.

(51) Int. Cl.

| | |
|---|---|
| ***E04H 3/12*** | (2006.01) |
| ***B66F 7/00*** | (2006.01) |
| ***E04H 3/30*** | (2006.01) |
| ***B66F 7/06*** | (2006.01) |

(52) U.S. Cl.

CPC ..... *E04H 3/123* (2013.01); *B66F 7/065* (2013.01); *E04H 3/126* (2013.01); *E04H 3/30* (2013.01); *B66F 2700/12* (2013.01)

(58) Field of Classification Search

CPC ..... E04H 3/123; B66F 2700/12

See application file for complete search history.

(56) References Cited

U.S. PATENT DOCUMENTS

| | | | | |
|---|---|---|---|---|
| 2,183,056 A | | 12/1939 | Albach et al. | |
| 2,706,835 A | | 4/1955 | Ullom | |
| 2,846,738 A | * | 8/1958 | Walworth | E04H 3/123 52/9 |
| 2,990,587 A | | 7/1961 | Murphy | |
| 3,107,398 A | * | 10/1963 | Murphy | E04H 3/123 52/10 |
| 3,107,399 A | * | 10/1963 | Murphy | E04H 3/123 52/10 |
| 3,142,871 A | * | 8/1964 | Harms | E04H 3/126 52/10 |
| 3,222,827 A | | 12/1965 | Smith | |

(Continued)

FOREIGN PATENT DOCUMENTS

| | | | | |
|---|---|---|---|---|
| BE | EP 2604776 A1 | * | 6/2013 | E04H 3/123 |
| EP | 2604776 A1 | | 6/2013 | |

(Continued)

*Primary Examiner* — Jeanette E Chapman

(74) *Attorney, Agent, or Firm* — Carlson, Gaskey & Olds, P.C.

(57) ABSTRACT

A seating system according to an exemplary aspect of the present disclosure includes, among other things, a plurality of seating risers configured to telescope relative to one another. Further, at least one of the plurality of seating risers is a powered seating riser configured to deploy and retract the plurality of seating risers. The powered seating riser includes a belt drive system. Additionally, the plurality of seating risers are adjustable between a lowered position and a raised position.

11 Claims, 11 Drawing Sheets

(56) References Cited

U.S. PATENT DOCUMENTS 3,389,511 A 6/1968 Drehobl
3,429,081 A 2/1969 McClelland
3,667,171 A 6/1972 McClelland et al.
3,738,612 A 6/1973 Hartman
3,869,835 A * 3/1975 Mackintosh ..... E04H 3/123 52/183
3,881,140 A 4/1975 Hartman
4,155,202 A 5/1979 Hartman
4,189,876 A 2/1980 Crossman et al.
4,367,612 A 1/1983 Sutter
4,490,949 A 1/1985 Sutter et al.
4,909,000 A 3/1990 Mackintosh
5,069,007 A 12/1991 Paddock
5,145,029 A 9/1992 Blasdell et al.
5,517,091 A 5/1996 Becher et al.
5,517,789 A * 5/1996 Sugiyama ..... E04H 3/123 297/257
5,660,000 A 8/1997 MacIntyre
5,810,430 A 9/1998 Bryjak et al.
5,921,031 A 7/1999 Williams
6,055,780 A 5/2000 Yamazaki
6,199,325 B1 3/2001 Winship
6,293,053 B1 9/2001 Norman
6,324,790 B1 12/2001 Victor et al.
6,415,551 B1 7/2002 Norman
6,625,932 B1 9/2003 Littlefield
7,900,402 B2 * 3/2011 Staten ..... E04H 3/123 52/10
7,986,416 B2 7/2011 Chiu
8,528,971 B2 9/2013 Bilodeau et al.
8,555,554 B2 * 10/2013 Koch et al. ..... E04H 3/123 52/10
9,194,145 B2 * 11/2015 Staten ..... E04H 3/123
2002/0116885 A1 * 8/2002 Thiede ..... E04H 3/24 52/263
2003/0009950 A1 1/2003 Hallberg
2004/0035060 A1 2/2004 Miyazaki et al.
2004/0128918 A1 7/2004 Yang et al.
2007/0138450 A1 * 6/2007 Bradley ..... B66F 7/0625 254/9 C
2008/0083170 A1 4/2008 Staten et al.
2008/0190038 A1 8/2008 Jacobs et al.
2010/0180515 A1 * 7/2010 Favell ..... E04H 3/123 52/7
2010/0183388 A1 7/2010 Chiu
2010/0192477 A1 8/2010 Wisner et al.
2011/0016798 A1 1/2011 Jacobs et al.
2011/0099915 A1 * 5/2011 Sudkamp et al. .... B66F 7/0658 52/9
2011/0107682 A1 5/2011 Staten et al.
2014/0069026 A1 * 3/2014 Parker ..... E04H 3/123 52/7

FOREIGN PATENT DOCUMENTS

FR 2498236 A1 * 7/1982 ..... E04H 3/123
MX WO 2012150853 A1 * 11/2012 ..... E04H 3/123

* cited by examiner

SEATING SYSTEM

RELATED APPLICATIONS

This application is a divisional of prior U.S. application Ser. No. 14/807,191, filed Jul. 23, 2015, the entirety of which is herein incorporated by reference. The '191 application claims the benefit of U.S. Provisional Application No. 62/027,964, filed Jul. 23, 2014, the entirety of which is herein incorporated by reference.

BACKGROUND

The present disclosure relates to portable seating systems, and more particularly to a powered telescopic seating riser having decks capable of being vertically raised.

Seating risers are designed for use in auditoriums, gymnasiums, and event halls, as examples, to accommodate spectators on portable seats, such as folding chairs, or on seats affixed to the risers. Certain facilities may require seating risers that are capable of being moved between a retracted position for storage and a deployed position for use.

SUMMARY

A seating system according to an exemplary aspect of the present disclosure includes, among other things, a plurality of seating risers configured to telescope relative to one another. Further, at least one of the plurality of seating risers is a powered seating riser configured to deploy and retract the plurality of seating risers. The powered seating riser includes a belt drive system. Additionally, the plurality of seating risers are adjustable between a lowered position and a raised position.

Another seating system according to an exemplary aspect of the present disclosure includes, among other things, a plurality of seating risers adjustable between a lowered position and a raised position. The plurality of seating risers are also configured to telescope relative to one another between a deployed position and a retracted position. The system further includes an actuator mounted to a scissor lift, which is configured to adjust a vertical position of at least one of the plurality of seating risers. The actuator slides a roller of the scissor lift in a direction parallel to the deployment and retraction of the plurality of seating risers.

A method according to an exemplary aspect of the present disclosure includes, among other things, moving a plurality of seating risers to one of a deployed position and a retracted position, and adjusting a height of at least one of the plurality of seating risers between a lowered position and a raised position using a scissor lift. The scissor lift includes a roller configured to slide in a direction parallel to the direction of deployment and retraction of the seating risers.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figures 1A, 1B:
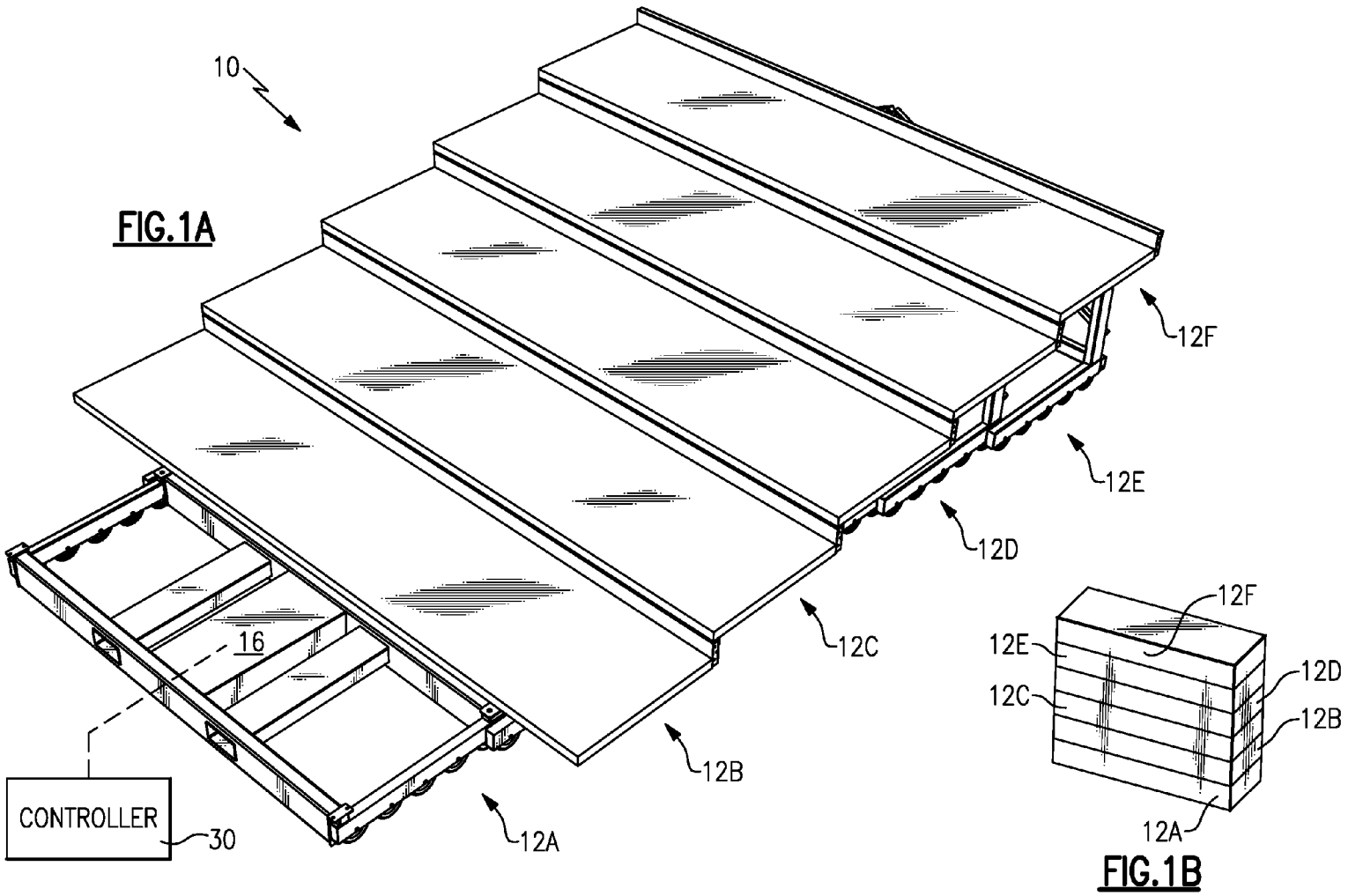
FIG. 1A is a perspective view of a seating system in a deployed position.
FIG. 1B is a schematic illustration of the seating system in a retracted position.
Figure 3A:
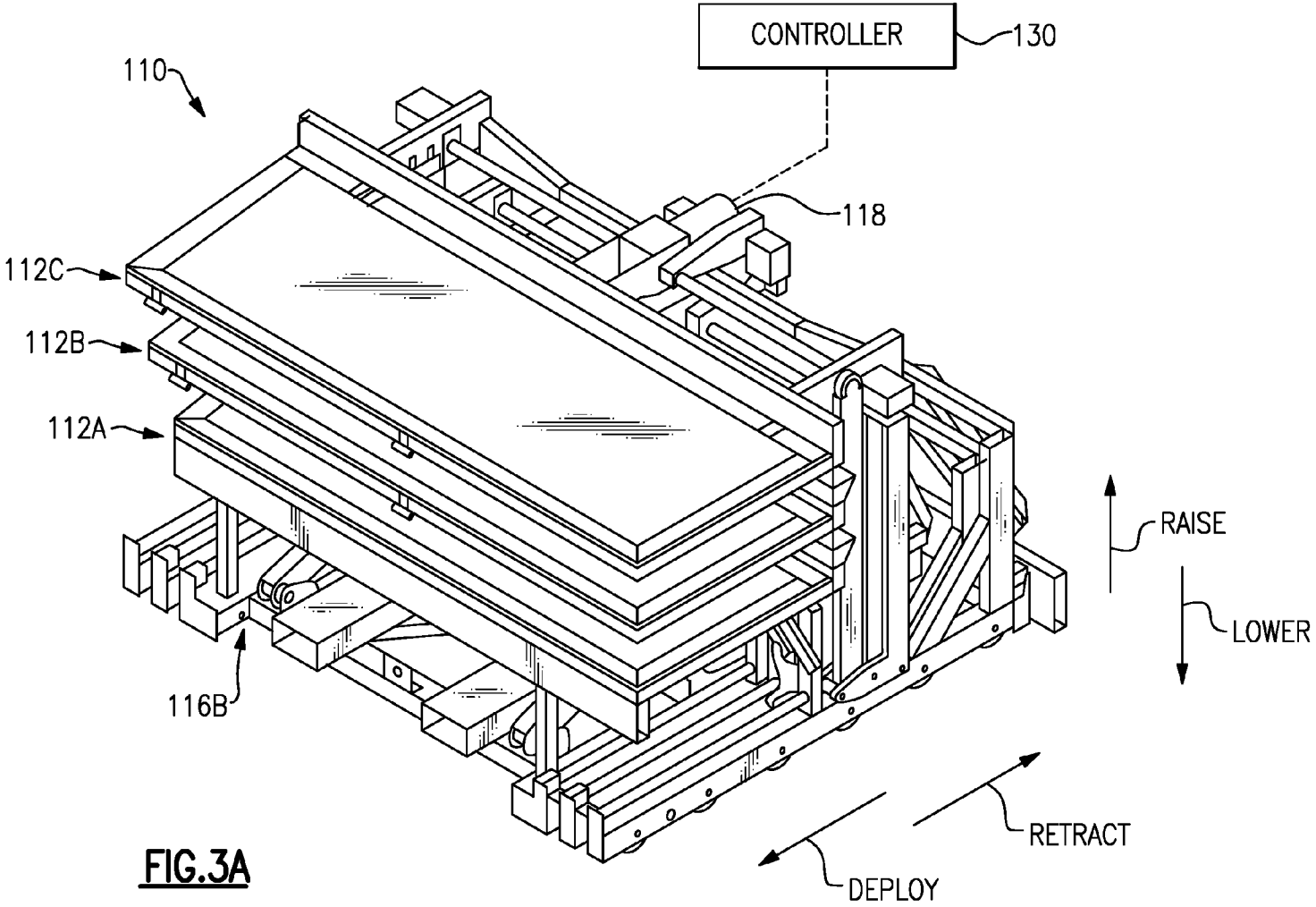
FIG. 3A is a perspective view of another example seating system in a retracted position.

An exemplary seating system 10 (which is sometimes collectively called a "riser") has a plurality of telescopic seating risers 12A-12F configured to deploy (FIG. 1A) and retract (schematically represented in FIG. 1B) relative to one another. While six seating risers 12A-12F are shown in FIGS. 1A-1B, it should be understood that this application extends to seating systems with any number of risers. For example, FIG. 3A illustrates an example including three risers.

Each seating riser 12A-12F (sometimes each "riser" is referred to as a "level" or a "rise") generally includes a support structure which supports a respective deck. The decks may support spectators thereon, either directly, such as when spectators stand directly on the decks, or indirectly by way of fixed benches or removable seats, such as folding chairs.

In one example, the lower level seating risers are narrower in width and shorter in height relative to the upper level seating risers (e.g., lowest level seating riser 12A is narrower in width and shorter in height relative to seating riser 12B, and so on) to facilitate telescoping of the seating system 10 between the deployed (FIG. 1A) and retracted positions (FIG. 1B).

In one example, one of the seating risers is a powered seating riser including a belt drive system 16. The powered seating riser is operable to drive the deployment (in the "deploy" direction, labeled in the Figures) and retraction (in the "retract" direction, also labeled in the Figures) the seating system 10, and to further laterally steer the seating risers 12A-12F side-to-side during deployment and retraction. In the disclosed non-limiting embodiment the lowest riser 12A is the powered seating riser. Although any of the seating risers 12A-12F may be a powered seating riser, the lowest riser 12A may best facilitate steering of the seating risers 12A-12F in many examples.

Figure 2:
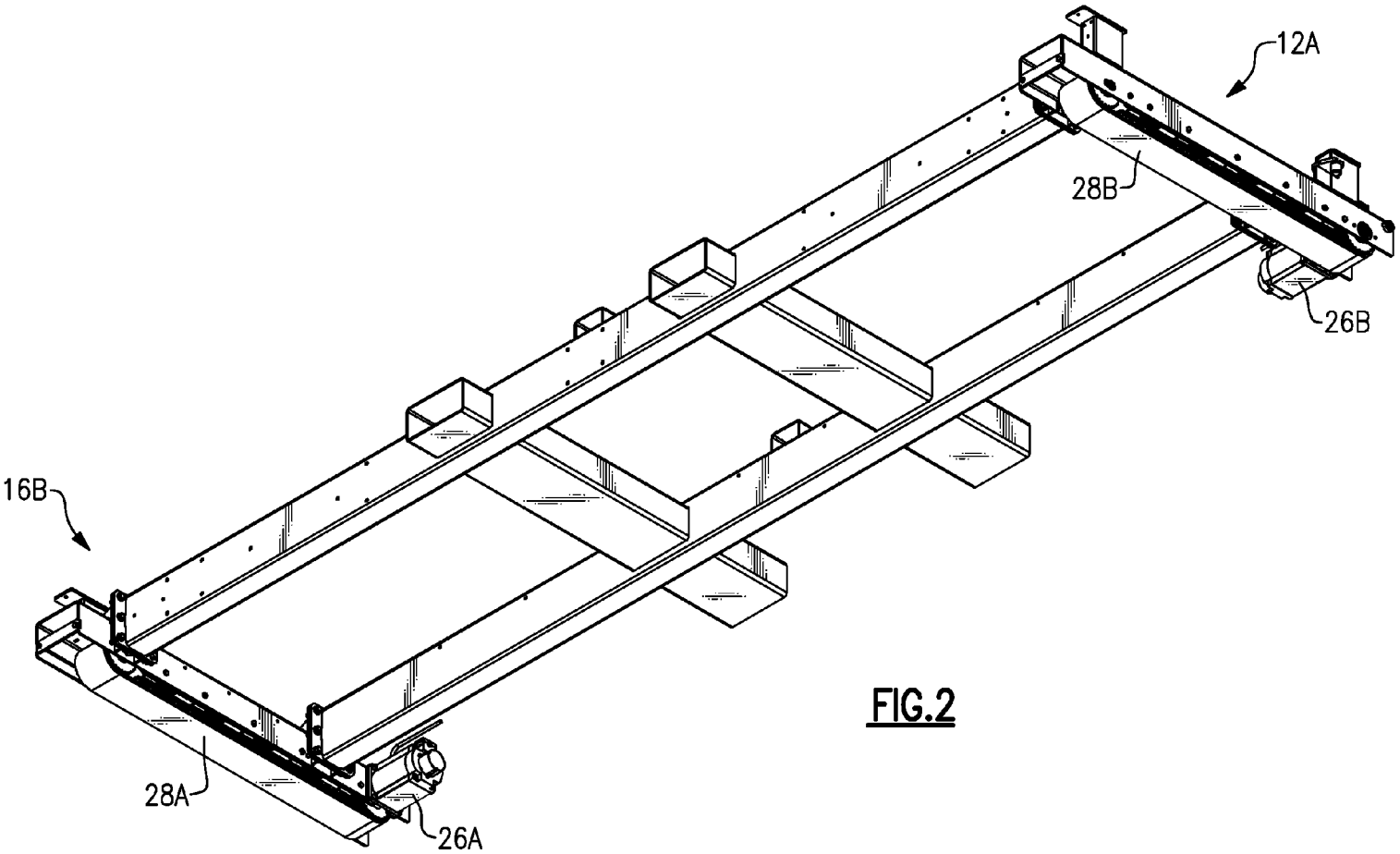
FIG. 2 is a bottom-perspective view of an embodiment of a powered seating riser including a dual-belt drive system.

FIG. 2 illustrates an example powered seating riser. In the illustrated example, the powered seating riser includes a dual-belt drive system 16B. The drive system 16B includes two variable frequency motors, or drives, 26A, 26B, each driving a respective belt, or track, 28A, 28B. Conceptually, the dual-belt drive system 16B provides the seating system 10 with a motive force, as well as steering (e.g., steering in a lateral, side-to-side, direction), in a "tank-like" manner. To this end, the variable frequency drives 26A, 26B may be disposed at opposite sides, or flanks, of the powered seating riser 12A.

The overall system 10, along with the dual-belt drive system 16B, is described in U.S. patent application Ser. No. 13/315,606 ("the '606 application"), filed Dec. 9, 2011, the entirety of which is herein incorporated by reference.

Figure 3B:
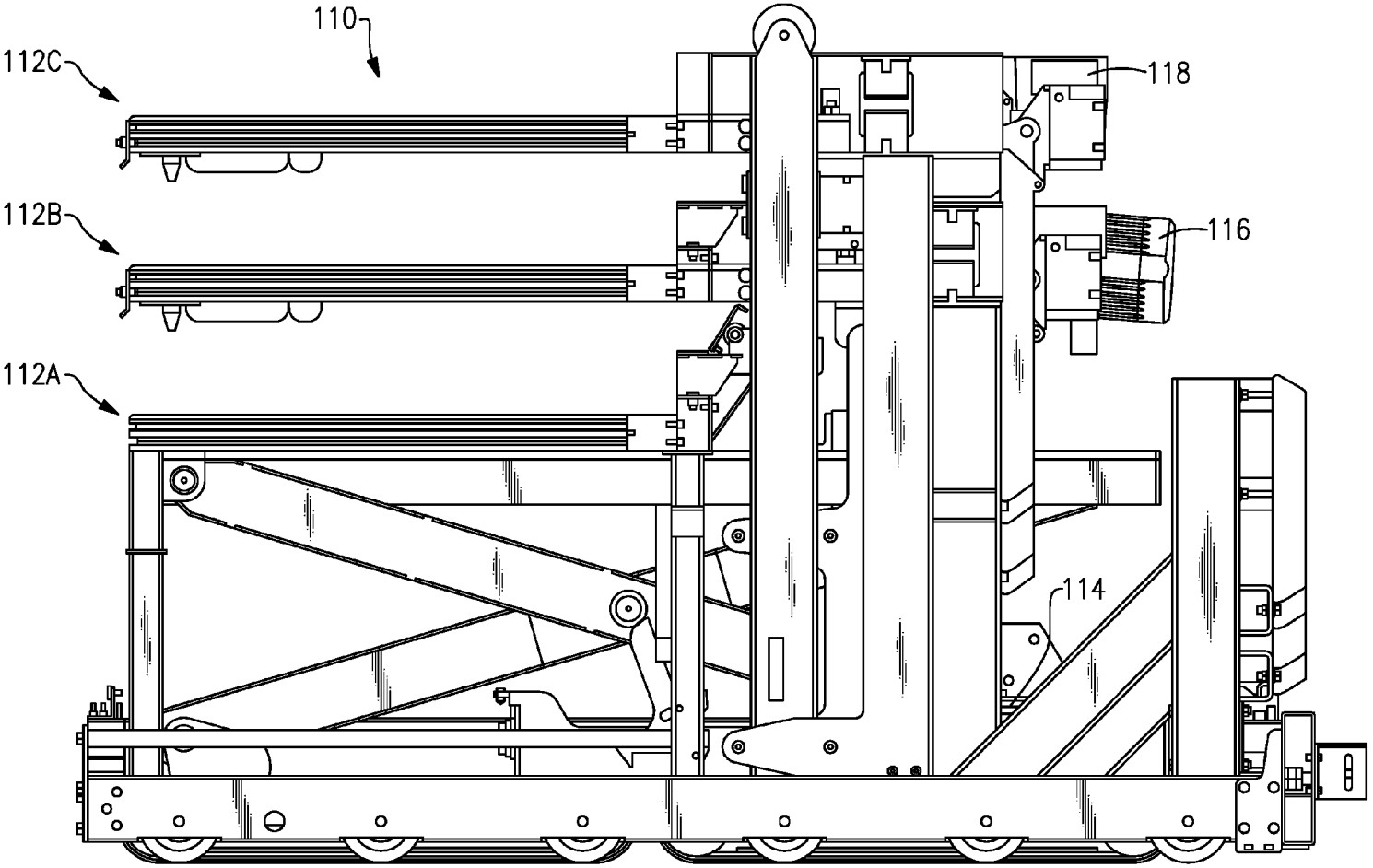
FIG. 3B is a side view of the seating system in the retracted position.

FIGS. 3A-3B illustrate another seating system 110 according to the present disclosure. The seating system 110 includes three seating risers 112A-112C, although, again, any number of risers could be included. In this example, the lowest riser 112A is a powered seating riser, substantially similar to the riser 12A of FIGS. 1A-2. In particular, the lowest riser 112A in one example includes the dual-belt drive system of FIG. 2. The seating system 110 may also include a laser alignment system, such as that described in the '606 application.

Figure 4:
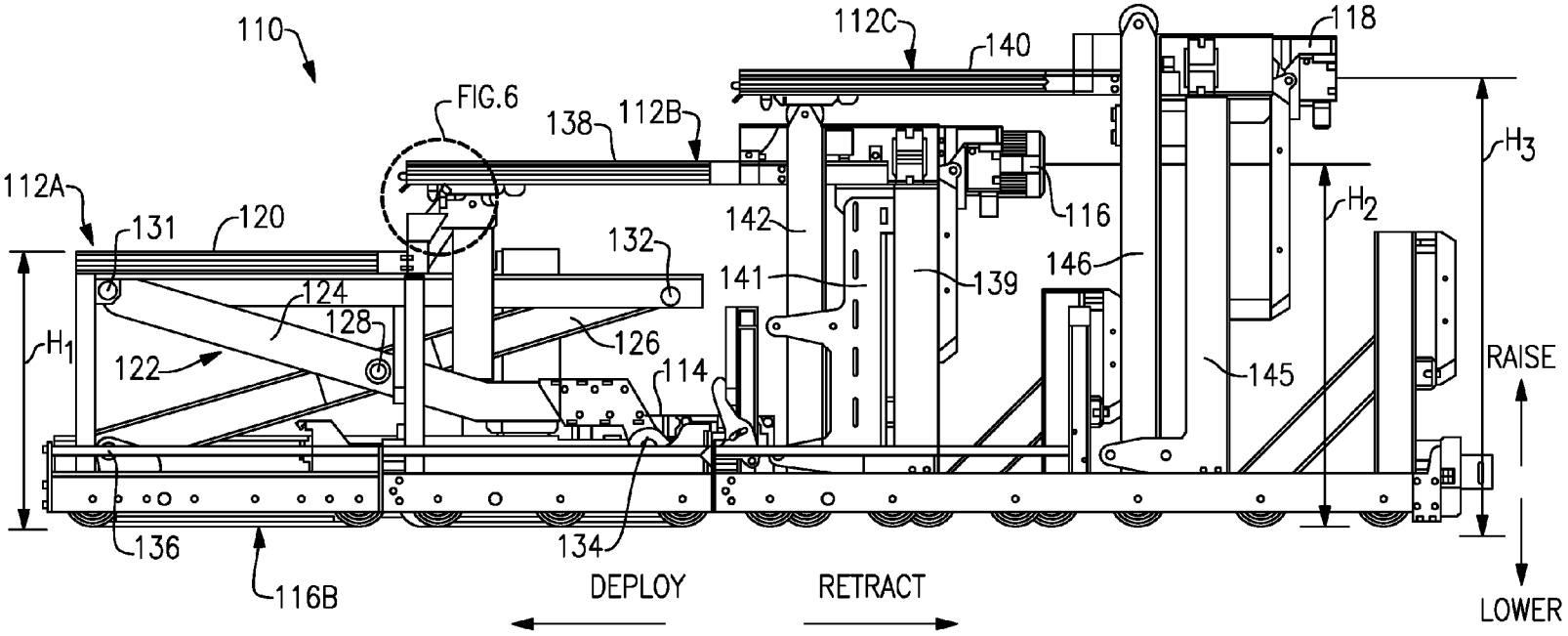
FIG. 4 is a side view of the seating system of FIG. 3A in a deployed position.

The lowest riser 112A is configured to be driven forward or rearward, and steered laterally (as needed), to move between a deployed and retracted position. In this example, the lowest riser 112A moves in response to commands from a controller 130. The upper risers 112B, 112C follow the lowest riser 112A as it moves between the deployed and retracted positions. FIGS. 3A-3B illustrate the risers 112A-112C in the retracted position. FIG. 4 illustrates the risers 112A-112C in the deployed position.

Figure 5A:
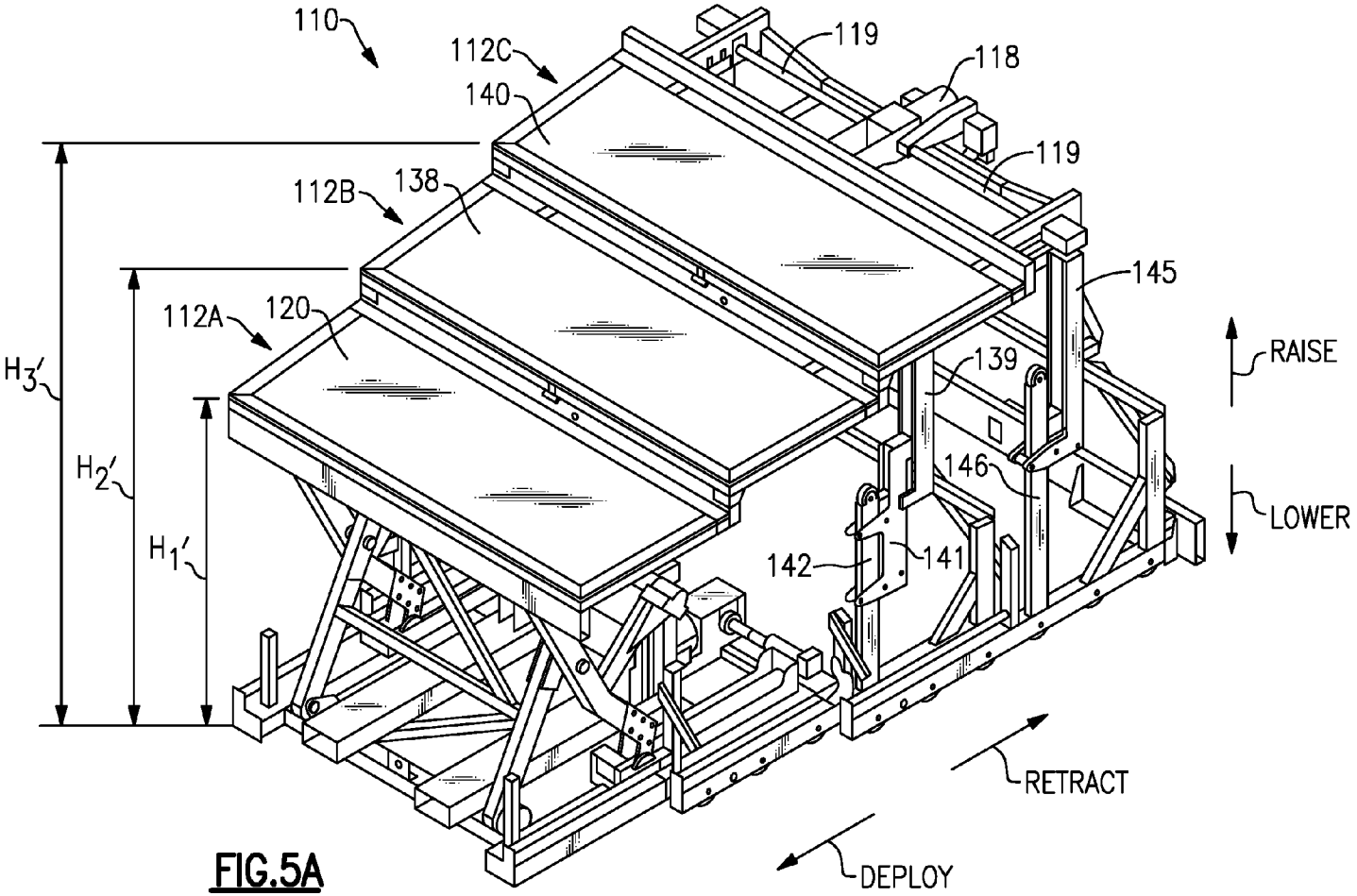
FIG. 5A is a view of the seating system of FIG. 3A in a raised position.
Figure 5B:
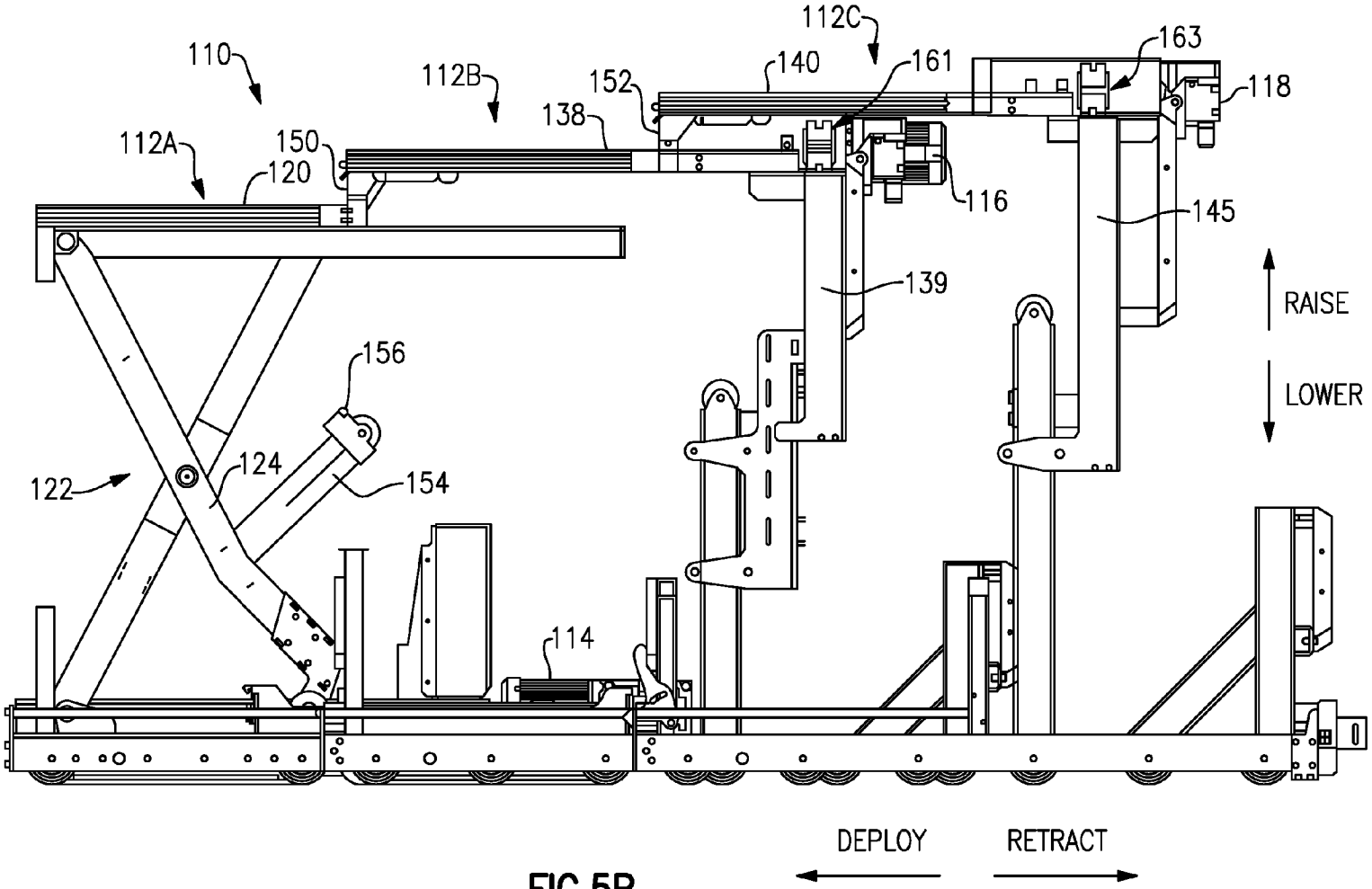
FIG. 5B is a side view of the seating system in the raised position.

Further, the seating system 110 includes a plurality of actuators 114, 116, 118 (perhaps best seen in FIGS. 3B and 4) configured to vertically move the risers 112A-112C between a lowered position of FIGS. 3A-3B (e.g., see the "lower" direction, labeled in the Figures) and a raised position of FIGS. 5A-5B (e.g., see the "raise" direction, labeled in the Figures). The actuators 114, 116, and 118 are electrically coupled to the controller 130 and are responsive to commands from the controller 130. In one example, the controller 130 commands the actuators such that the several levels (e.g., the risers 112A-112C) change elevation at the same time. In the example, the controller 130 commands the first riser 112A to start moving vertically (e.g., in the lower direction), and then commands the second riser 112B to start moving vertically after a delay, which can be a fixed value and vary depending on the particular application. The controller 130 next commands the third riser 112C to start moving after another delay, and so on (if there are additional risers). Ultimately, the delays reduce the likelihood of a collision between adjacent risers during vertical travel. In this example, if a fourth riser were present, that riser would start moving after the first riser 112A completes its travel. This "leapfrog effect" would continue until all levels (again, if present) complete their vertical travel.

It should be understood that the controller 130 is configured to provide the actuators 114, 116, 118, as well as the drive associated with the powered seating riser, with the appropriate instructions. In one example, a user provides instructions to the controller 130 via an interface. In another example, the controller 130 is programmed to automatically deploy and raise the risers, depending on the particular example. The controller 130 may include memory, a processor, hardware, and software necessary to receive, store, and send the appropriate instructions throughout the seating system 110.

With reference to FIG. 4, the lowest seating riser 112A includes a deck 120, which is vertically supported by a scissor lift 122. The scissor lift 122 includes first and second arms 124, 126, which are pivotably connected to one another (at point 128) and to the deck 120 (at points 131, 132).

Opposite the connection with the deck 120, the arm 124 is slidably connected to a roller 134. The roller 134 is configured to move in a direction parallel to the "deploy" and "retract" directions. This direction of movement allows for increased range (e.g., in the vertical direction) of movement of the scissor lift. The actuator 114 is configured to longitudinally adjust the position of the roller 134, which in turn raises and lowers the deck 120. Further, the arm 126 is pivotably connected opposite the pivotable connection 132, at 136. In the lowered position, the deck 120 is provided at a height $H_1$ above a ground surface.

In this example, the deck 138 of the second riser 112B is vertically supported by a drivable structure 139, an intermediate structure 141, and a vertical support post 142. The drivable structure 139 is connected to the intermediate structure 141 by way of one or more drivable rollers. The drivable structure 139 and the intermediate structure 141 are each configured to move in directions parallel to the "lower" and "raise" directions. In turn, the intermediate structure 141 is connected to the vertical support post 142 by a plurality of passive rollers. In this example, the actuator 116 drives the rollers of the drivable structure along the intermediate structure 141, which itself, in turn, travels along the vertical support post 142. The intermediate structure 141 allows additional vertical travel for the deck 138, however it is not required in all examples. When in the lowered position, the deck 138 is a height $H_2$ above a ground surface.

The third seating riser 112C includes a deck 140 positioned at a height $H_3$ in the lowered position. The deck 140 is vertically supported by a drivable structure 145, which is movable (e.g., by one or more drivable rollers) along a vertical support post 146 in response to the actuator 118. The drivable structure 145 is moveable in directions parallel to the "lower" and "raise" directions. It should be understood that the actuators 114, 116, 118 can be any type of known actuator, such as linear actuators including acme screws, ball screws, or another type of actuator including a nut moveable along a threaded shaft. Further, the linear actuator may be self-locking.

FIG. 5A is a perspective view illustrating the seating risers 112A-112C in a raised position. In the raised position, the deck 120 is a height $H_1'$ above a ground surface, which in one example is about 40 inches higher than the height $H_1$. Further, the deck 138 of the second riser 112B is a height $H_2'$ above a ground surface, which in one example is about 30 inches higher than the height $H_2$. Further, the deck 140 of the third riser 112C is a height $H_3'$ above a ground surface, which is about 20 inches higher than the height $H_3$ in one example.

In this example, the second riser 112B vertically travels further than the third riser 112C due to the intermediate structure 141. Further, the scissor lift 122 associated with the lowest riser 112A is configured to provide the largest amount of vertical travel. The increased vertical travel associated with the lowest riser 112A allows the lowest riser 112A to vertically align with the highest riser of an adjacent seating system (which may be in a vertically lowered position).

As illustrated in FIG. 5B, when the seating system 110 is in the raised position, the vertical gaps between the decks 120, 138, and 140 are sealed (e.g., substantially covered) by vertical flanges 150, 152. The flanges 150, 152 prevent unwanted access to the underside of the decks 120, 138 and 140, which increases the safety of the system 110.

Figure 5C:
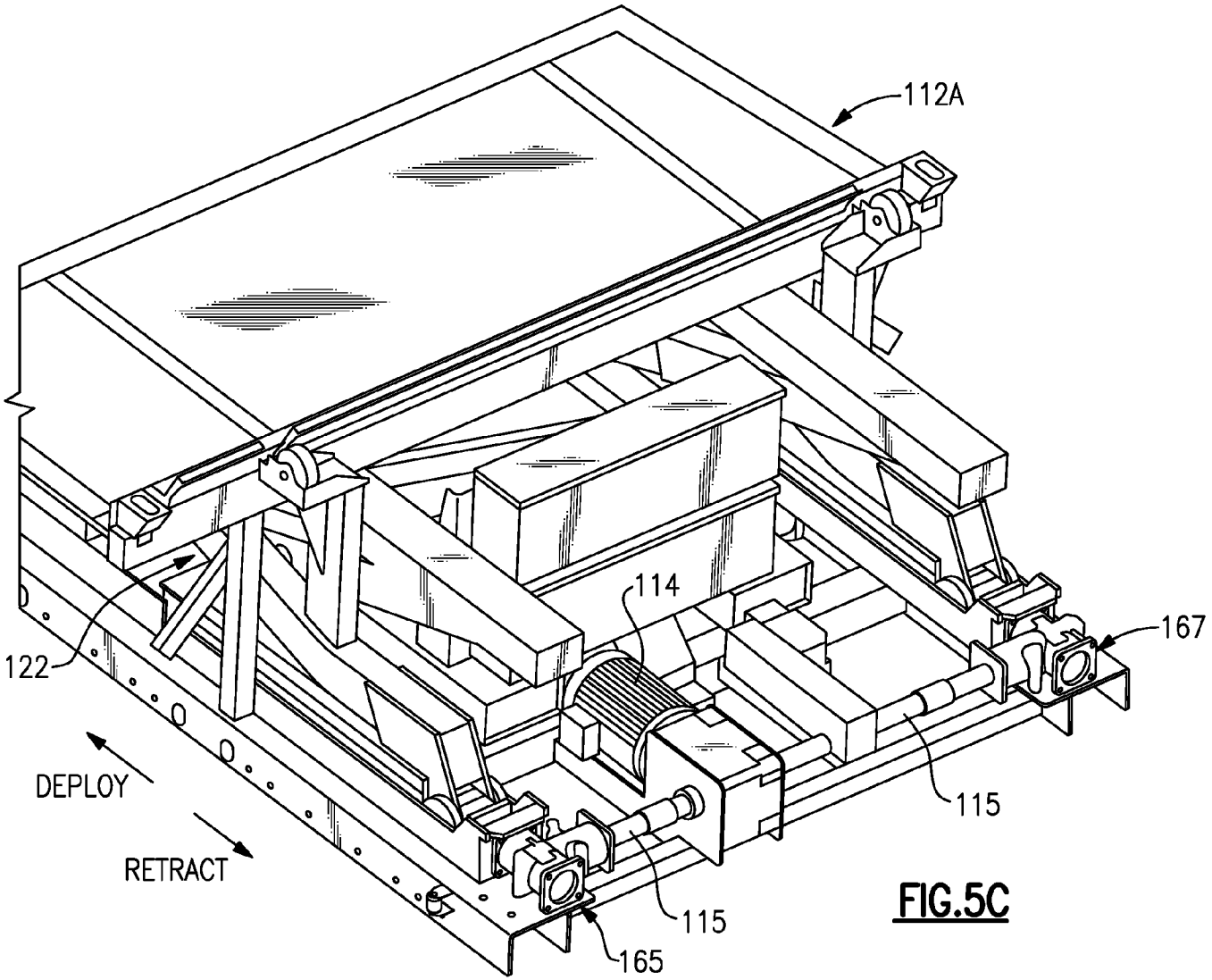
FIG. 5C is a view of the seating system, and illustrates gearboxes associated with a scissor lift.

In FIG. 5B, the actuators 116, 118 are connected to vertical drives, which may be linear actuators like ball screws or acme screws within respective drivable structures 139, 145, by way of a rotatable horizontal arm (such as arm 119 in FIG. 5A) and a respective right angle gearbox 161, 163. The right angle gearboxes 161, 163 convert an input rotation ninety degrees into an output rotation. Likewise, as illustrated in FIG. 5C, the actuator 114 drives a horizontal arm 115, which is connected to first and second right angle gearboxes 165, 167. The right angle gearboxes 165, 167 are arranged to drive the roller 134 in the deploy and retract directions. By providing right angle gearboxes between the actuators 114, 116, 118 and the respective linear actuators, maintenance is reduced relative to the prior systems (which may include additional parts like chains and sprockets that need lubrication), which in turn increases system reliability.

Figure 5D:
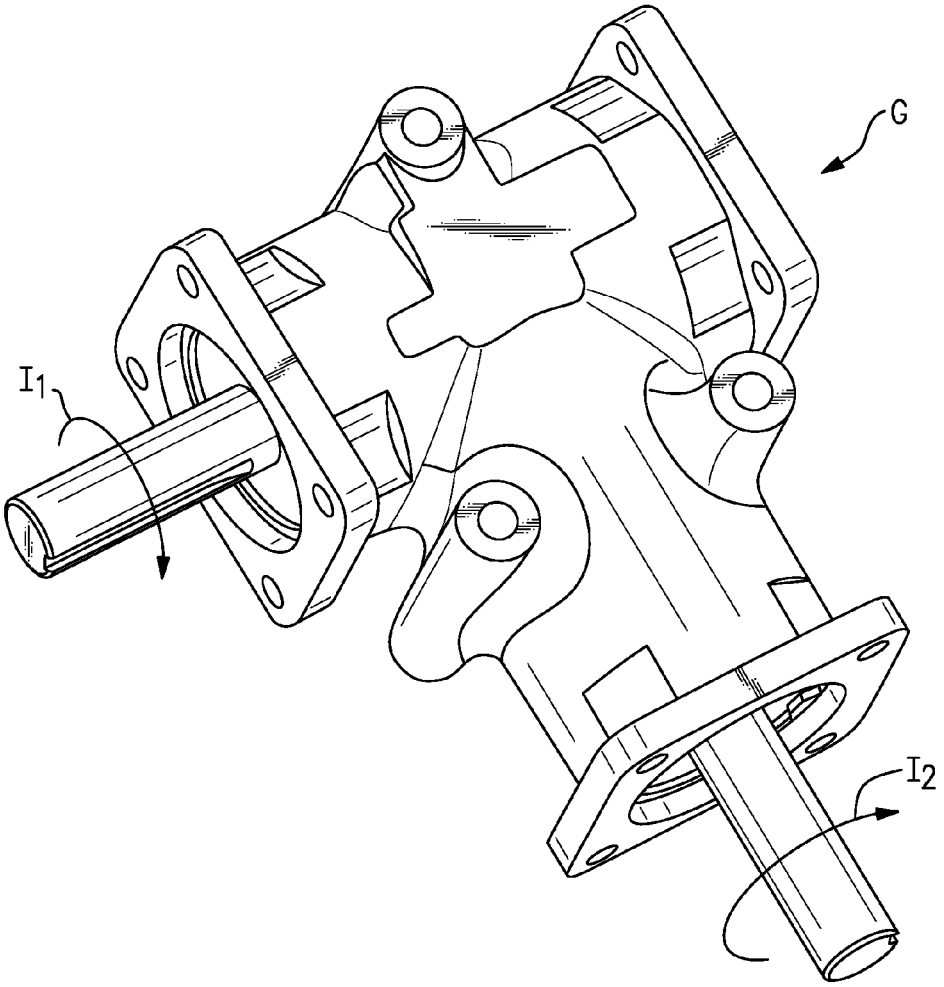
FIG. 5D is a view of an example right angle gearbox.

One example right angle gearbox G is shown in FIG. 5D. As mentioned, the right angle gearbox G is configured to convert an input rotation $I_1$ (e.g., from the horizontal arms 115, 119) by ninety degrees to an output rotation $I_2$, which in turn drives the linear actuators and adjusts riser position.

Figure 6:
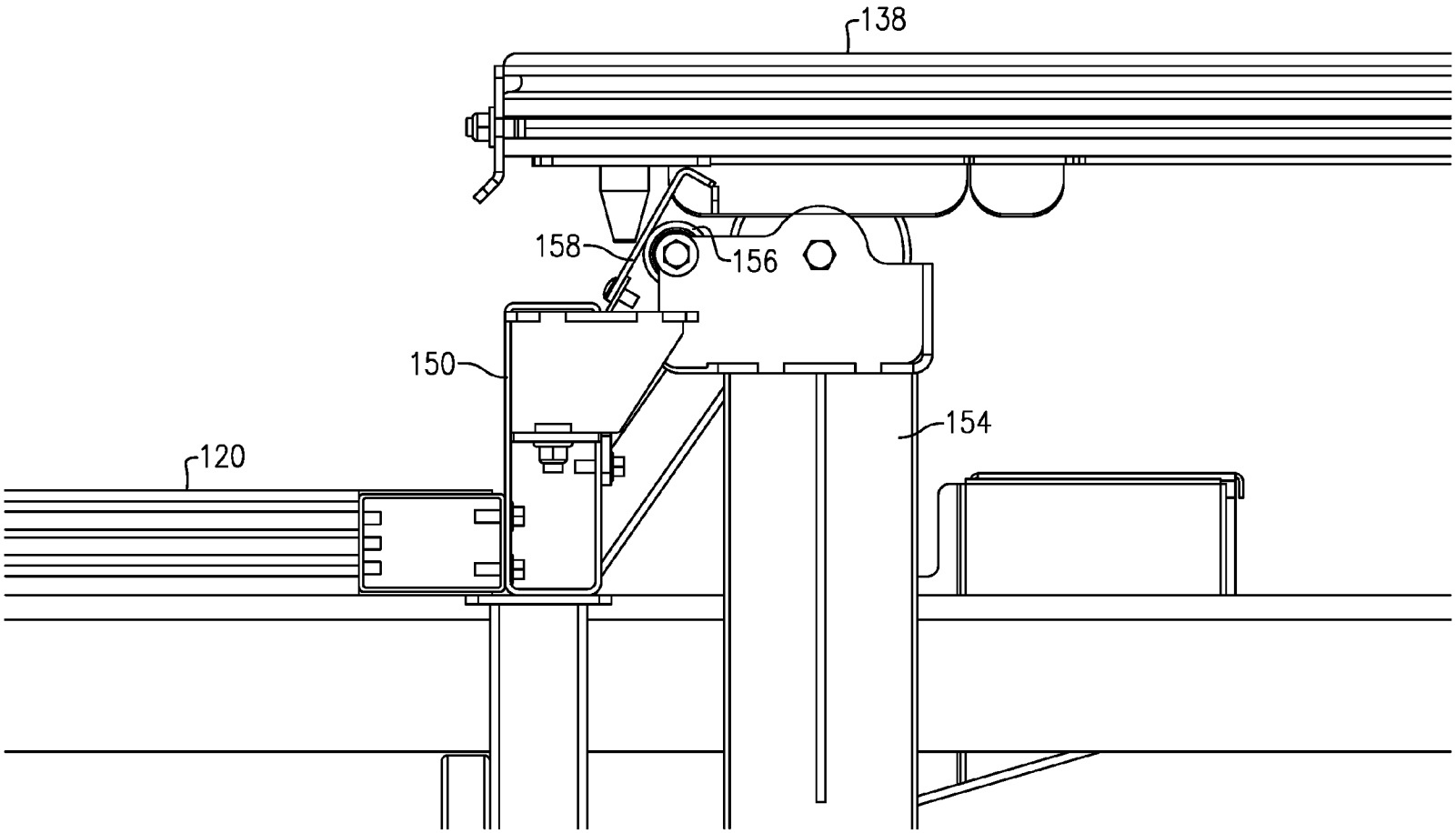
FIG. 6 is a close up view of the encircled area in FIG. 4.

In one example, the scissor lift 122 requires additional vertical space for packaging when the system 110 is in the lowered position. As illustrated in FIG. 6, in one example, a vertical gap exists between the upper surface of the flange 150 and the lower surface of the second deck 138. In this example, the arm 124 of the scissor lift 122 includes a projection 154 extending generally in a rearward direction (i.e., a direction parallel to the "retract" direction), which supports a cam 156. When the seating system 110 is in the lowered position, the cam 156 engages a flap 158, and rotates the flap 158 such that it contacts the lower surface of the deck 138. The combination of the vertical flange 150 and the flap 158 effectively seal the underside of the decks 120, 138 when the system 110 is in the lowered position.

Figure 7:
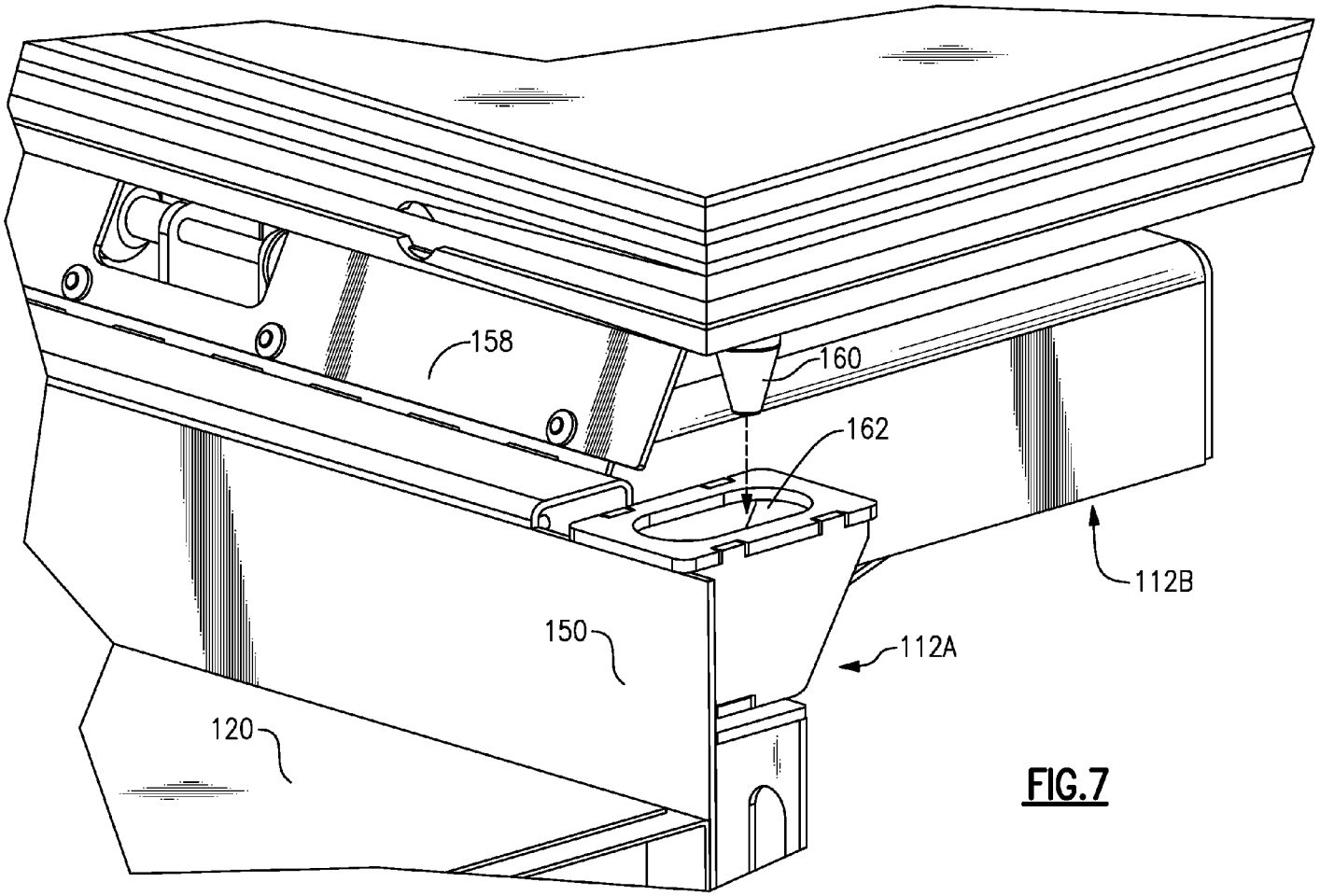
FIG. 7 illustrates a sway reduction feature according to the present disclosure.

FIG. 7 illustrates a sway reduction feature according to this disclosure. As illustrated in FIG. 7, the second deck 138 includes a node 160 projecting downwardly from a lower surface thereof. In this example, the node 160 is a frustoconical projection. The lowest riser 112A includes an opening 162 adjacent an upper surface of the flange 150. When in the raised position, the node 160 is received in the opening 162. Contact between the node 160 and the structure forming the opening 162 restricts lateral movement of the lowest riser 112A and the second riser 112B. It should be understood that a similar sway reduction feature can be provided between the second riser 112B and the upper riser 112C. Further, each riser can include more than one node/opening pair.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A method, comprising:

moving a plurality of seating risers to one of a deployed position and a retracted position;

adjusting a height of at least one of the plurality of seating risers between a lowered position and a raised position using a scissor lift, the scissor lift including a roller configured to slide in a direction parallel to the direction of deployment and retraction of the seating risers; and receiving a node projecting from a higher level seating riser within an opening in a lower level seating riser.

2. The method as recited in claim 1, further comprising:

rotating a flap with a cam connected to the scissor lift to cover a gap between adjacent seating risers.

3. The method as recited in claim 1, wherein at least one of the plurality of seating risers is a powered seating riser configured to deploy and retract the plurality of seating risers.

4. The method as recited in claim 3, wherein the powered seating riser includes a belt drive system.

5. A method, comprising:

moving a plurality of seating risers to one of a deployed position and a retracted position;

adjusting a height of at least one of the plurality of seating risers between a lowered position and a raised position using a scissor lift, the scissor lift including a roller configured to slide in a direction parallel to the direction of deployment and retraction of the seating risers; and wherein the scissor lift includes first and second arms pivotably connected to one another, the first and second arms connected to at least one of the plurality of seating risers.

6. The method system as recited in claim 5, wherein the scissor lift includes a projection supporting a cam, and wherein, when the seating system is in the lowered position, the cam engages a flap and rotates the flap to cover a gap between adjacent seating risers.

7. The method as recited in claim 6, wherein at least one of the first and second arms of the scissor lift is connected to a roller configured to slide in a direction parallel to the direction of deployment and retraction of the seating risers.

8. The method as recited in claim 1, wherein at least one of the plurality of seating risers includes a deck, a drivable structure, and an intermediate structure connected to the drivable structure by at least one first roller.

9. The method as recited in claim 1, wherein the node is a frustoconical projection.

10. A method, comprising:

moving a plurality of seating risers to one of a deployed position and a retracted position; and adjusting a height of at least one of the plurality of seating risers between a lowered position and a raised position using a scissor lift, the scissor lift including a roller configured to slide in a direction parallel to the direction of deployment and retraction of the seating risers, wherein the scissor lift is configured to raise an entirety of the at least one of the plurality of seating risers.

11. The method as recited in claim 10, wherein the at least one of the plurality of seating risers includes a front edge and a rear edge opposite the front edge, wherein the front and rear edges are raised and lowered evenly as the height of the at least one of the plurality of seating risers is adjusted.

* * * * *